US006761134B1

(12) United States Patent
Trant

(10) Patent No.: US 6,761,134 B1
(45) Date of Patent: Jul. 13, 2004

(54) WATER HEATER HAVING SELF-POWERED LOW NOX BURNER/FUEL-AIR DELIVERY SYSTEM

(75) Inventor: Troy E. Trant, Letohatchee, AL (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 10/384,848

(22) Filed: Mar. 10, 2003

(51) Int. Cl.[7] ..... F24H 9/20

(52) U.S. Cl. ..... 122/14.1; 122/14.2; 122/14.21; 122/17.2; 122/504; 431/12; 431/75

(58) Field of Search ..... 122/13.01, 14.1, 122/14.2, 14.21, 17.1, 17.2, 18.31, 504; 431/12, 75, 62, 63, 354

(56) References Cited

U.S. PATENT DOCUMENTS

| | | | | |
|---|---|---|---|---|
| 2,647,505 A | | 8/1953 | Bordt et al. | 126/67 |
| 3,185,201 A | | 5/1965 | Herbst et al. | 158/4 |
| 4,418,651 A | * | 12/1983 | Wyatt | 123/31.1 |
| 4,843,273 A | | 6/1989 | Dammers et al. | 310/306 |
| 5,427,086 A | | 6/1995 | Brownell | 126/110 R |
| 5,427,525 A | * | 6/1995 | Shukla et al. | 431/350 |
| 5,450,869 A | | 9/1995 | Brittain et al. | 136/203 |
| 5,495,829 A | | 3/1996 | Jayaraman et al. | 122/110 |
| 5,797,356 A | * | 8/1998 | Khizh | 122/18.31 |
| 6,019,098 A | | 2/2000 | Bass et al. | 126/344 |
| 6,053,163 A | | 4/2000 | Bass | 126/312 |

FOREIGN PATENT DOCUMENTS

DE 3148162 A1 * 6/1983

* cited by examiner

*Primary Examiner*—Jiping Lu
(74) *Attorney, Agent, or Firm*—Konneker & Smith, P.C.

(57) ABSTRACT

A fuel-fired natural draft water heater is provided with a self-powered, low NOx burner system in which a thermoelectric generator is positioned to be heated by the water heater's fuel burner during firing thereof and used to power an auxiliary combustion air fan which operates to supply to the burner system a quantity of combustion air in addition to that normally supplied by the natural draft of the water heater during operation thereof. The burner system is configured in a manner such that the water heater is operative even if either or both of the thermoelectric generator and the auxiliary combustion air fan fail to function.

14 Claims, 3 Drawing Sheets

WATER HEATER HAVING SELF-POWERED LOW NOX BURNER/FUEL-AIR DELIVERY SYSTEM

BACKGROUND OF THE INVENTION

The present invention generally relates to fuel-fired heating apparatus and, in a preferred embodiment thereof, more particularly relates to a self-powered low NOx burner/fuel-air delivery system representatively incorporated in a fuel-fired natural draft water heater.

Residential gas-fired water heaters are required to produce less emissions of NOx compounds for certain Air Quality Management Districts (AQMD'S) of California and Texas. Present gas-fired water heaters are generally non-powered (i.e., natural draft) appliances and the marketplace requires replacement water heaters to be "drop-in" appliances which precludes adding electrical service to installations. Contemporary non-powered low NOx emission burners are limited in such a way that their air/fuel ratios remain fixed in operation, with size constraints generally limiting the amount of primary aeration deliverable to the burner. Their operation thus tends to be less flexible within semi-sealed systems from the standpoint of reducing their NOx emissions by increasing primary aeration thereto. Powered burner systems have been demonstrated in many examples as producing less NOx emissions. However, providing additional electrical service to a gas-fired water heater imposes additional burdens on the consumer and becomes a barrier to rapid replacement Of the water heater.

From the foregoing it can be seen that it would be desirable to provide a fuel-fired water heater having a self-powered low NOx combustion system that does not have the operating limitations and reliability issues of non-powered burners but provides the functionality of a powered burner without the use of external power. Additionally, it would be desirable to provide such a self-powered combustion system which, in the event in the failure of its self-powering portion, would continue to operate in a conventional non-powered mode until corrective action could be taken.

SUMMARY OF THE INVENTION

In carrying out principles of the present invention, in accordance with a preferred embodiment thereof, a specially designed fuel-fired low NOx heating apparatus is provided which is representatively a fuel-fired, natural draft water heater but could alternatively be another fuel-fired heating apparatus such as, for example, a boiler or a furnace.

The water heater has a water storage tank, a combustion chamber, a fuel burner disposed within the combustion chamber, and a flue communicated with the combustion chamber and extending through the tank. According to a key feature of the invention, the water heater is provided with a specially designed self-powered fuel-air delivery system for delivering fuel and combustion air to the burner for combustion thereby to form combustion gases which are received and discharged by the flue which transfers combustion gas heat to water stored in the tank.

The fuel-air delivery system includes a fuel supply structure operative to discharge a quantity of fuel received from a source thereof, a first flow path for receiving the discharged fuel and a first quantity of combustion air and flowing the received fuel and air to the burner, a thermoelectric generator positioned to be heated by the burner during firing thereof, a second flow path through which a second quantity of combustion air may be delivered to the burner, and a fan structure preferably disposed externally of the combustion chamber and operable by the thermoelectric generator to deliver at least one of the first and second quantities of combustion air to the burner. According to a feature of the invention, the fuel-air delivery system is configured in a manner such that its associated fuel-fired heating apparatus remains operable even if either or both of the thermoelectric generator and the fan structure fail to function.

In a first representative embodiment of the water heater, in which the NOx emissions of the water heater are reduced by increasing the primary aeration of the burner, the first flow path is defined by a fuel-air mixing duct extending into and through the combustion chamber to an inlet portion of the burner, the second flow path is defined by an auxiliary combustion air duct extending into the combustion chamber and being connected to the fuel-air mixing duct, and the thermoelectrically driven fan structure is coupled to the auxiliary combustion air duct and is operative to flow the second, auxiliary quantity of combustion air therethrough into the fuel-air mixing duct.

In a second representative embodiment of the water heater, in which the NOx emissions of the water heater are also reduced by increasing the primary aeration of the burner, the first flow path is defined by a fuel-air mixing duct extending into and through the combustion chamber to an inlet portion of said burner, the auxiliary combustion air duct is eliminated, the thermoelectrically driven fan structure is connected in the fuel-air mixing duct, and all of the second flow path extends through the interior of said fuel-air mixing duct.

In a third representative embodiment of the water heater, in which the NOx emissions of the water heater are lowered by both (1) increasing the primary aeration of the burner and (2) providing for flue gas recirculation to the burner, the first flow path is defined by a fuel-air mixing duct extending into and through the combustion chamber to an inlet portion of the burner, the fan structure is coupled to said fuel-air mixing duct, the second flow path extends through said first flow path, and the water heater further comprises an auxiliary flue gas recirculating duct extending through the combustion chamber, coupled to the fuel-air mixing duct, and operative to flow into the fuel-air mixing duct a quantity of combustion gases created by the burner during firing thereof. The inlet of the auxiliary flue gas recirculating duct may be disposed within the combustion chamber or positioned within the flue.

In a fourth representative embodiment of the water heater, in which the NOx emissions of the water heater are lowered using a staged combustion technique, the first flow path is defined by a fuel-air mixing duct extending into and through the combustion chamber to an inlet portion of the burner, the second flow path is defined by an auxiliary combustion air supply duct which is not connected to the fuel-air mixing duct but extends into the combustion chamber to adjacent a secondary combustion zone near the burner, and the thermoelectrically driven fan is connected in the auxiliary combustion air supply duct to flow the second quantity of combustion air therethrough, during firing of the burner, into the secondary combustion zone.

DETAILED DESCRIPTION

Figure 1:
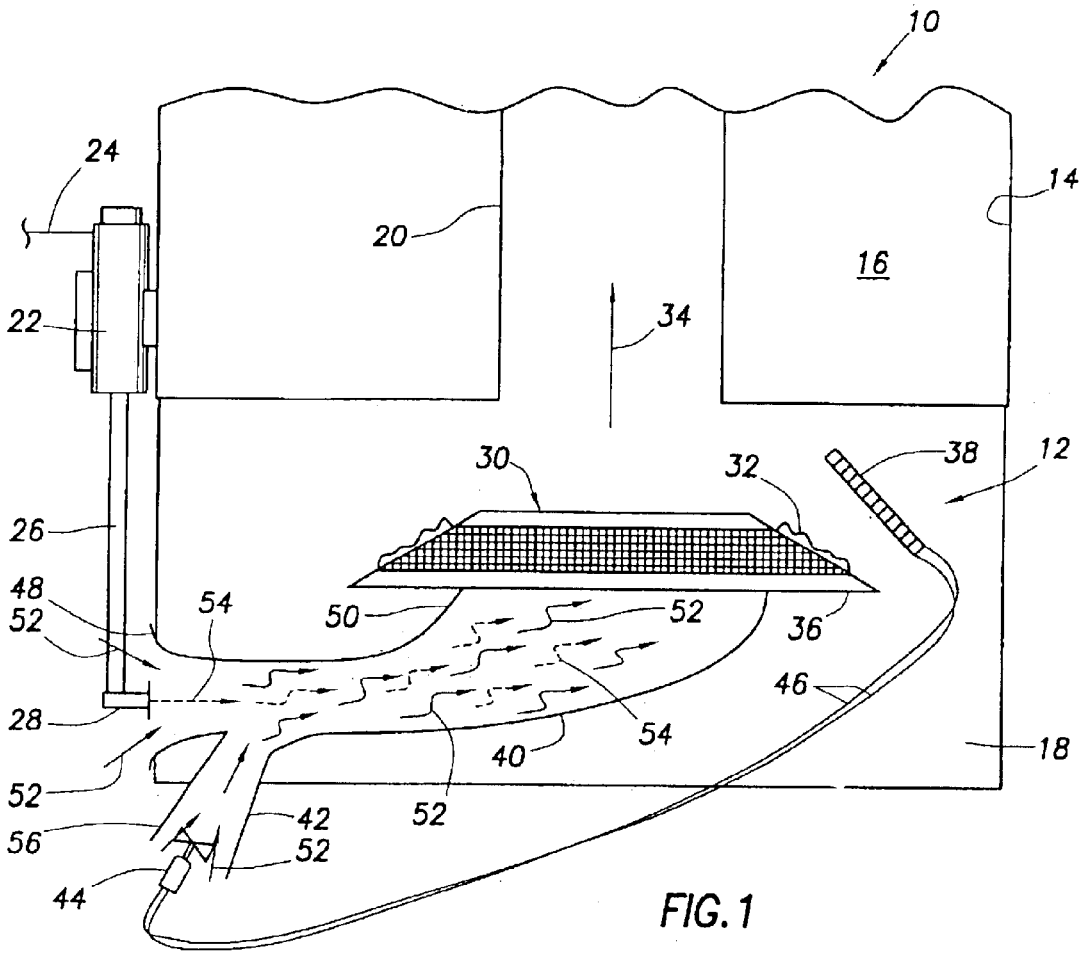
FIG. 1 is a schematic partial cross-sectional view through a gas-fired, natural draft water heater having incorporated therein a specially designed self-powered, low NOx burner/fuel-air delivery system embodying principles of the present invention.

Schematically depicted in simplified cross-sectional form in FIG. 1 is a lower portion of a fuel-fired heating appliance, representatively a gas-fired natural draft water heater 10, having incorporated therein a specially designed self-powered, low NOx burner/fuel-air delivery system 12 embodying principles of the present invention. While various representative embodiments of the water heater 10 will be described herein, it should be readily appreciated by those of ordinary skill in this particular art that the invention could also be advantageously utilized in a variety of other types of fuel-fired heating appliances, using other types of fuels, such as boilers, furnaces and the like, and is not limited to water heaters.

Water heater 10 has an insulated metal tank 14 in which a quantity of water 16 is stored, and a combustion chamber 18 disposed at the lower end of the tank 14. An exhaust flue 20 communicates at a lower end with the interior of the combustion chamber 18 and extends upwardly through the interior of the tank 14, being in thermal communication with the water 16 in the tank 14. A thermostatic gas supply valve 22 is suitably mounted on a side portion of the tank 14 and is supplied with gaseous fuel, from a source thereof, via a gas inlet pipe 24. A gas outlet pipe 26 extends downwardly from the valve 22 to a gas discharge nozzle structure 28.

Still referring to FIG. 1, the burner/fuel-air delivery system 12 includes a gas burner 30 suitably supported within the combustion chamber 18. During firing thereof the burner 30 creates a main flame 32 and also generates hot combustion gases 34 which are upwardly discharged through the flue 20 which transfers combustion gas heat to the stored water 16. As illustrated in FIG. 1, the burner 30 is disposed beneath the lower end of the flue 20 and has an inlet side 36.

Burner/fuel-air delivery system 12 also includes a thermoelectric generator 38 positioned within the combustion chamber 18 to receive heat from the main burner flame 32 and responsively generate electrical energy; a fuel-air mixing duct 40; an auxiliary combustion air supply duct 42; and a combustion air supply fan structure 44 operatively coupled to the thermoelectric generator 38 by electrical power leads 46.

Fuel-air mixing duct 40 has an inlet 48, extends into and through the combustion chamber 18, and is connected at an outlet end 50 thereof to the inlet side 36 of the burner 30. During operation of the natural draft water heater 10, a first quantity of combustion air 52, together with fuel 54 exiting the gas discharge nozzle 28, is drawn into the duct inlet 48 and flowed through the duct 40 to the burner 30 for combustion thereby to create the main burner flame 32 and the resulting hot combustion gases 34 which upwardly traverse the interior of the flue 20 and heat the water 16.

The auxiliary air supply duct 42 has an inlet 56, extends into the combustion chamber 18, and is connected to the fuel-air mixing duct 40 representatively near its inlet 48. As schematically shown in FIG. 1, the combustion air supply fan structure 44 is disposed within the auxiliary duct 42 and externally Of the combustion chamber 18. During operation of the water heater 10, electricity thermally produced by the generator 38 drives the fan 44 which, in turn, forces a second quantity of combustion air 52 into the fuel-air mixing duct 40 to supplement the previously mentioned first quantity of combustion air 52 entering the inlet 48 of the fuel-air mixing duct 40. This thermoelectrically driven operation of the fan 44 thus increases the primary aeration of the burner 30, thereby desirably reducing the NOx emissions of the water heater 10. When the burner 30 shuts down, the thermoelectrically driven fan 44 correspondingly shuts down so that supplemental combustion air 52 is not forced into the duct 40 via the duct 42 until subsequent firing of the burner 30 again transfers thermal energy to the thermoelectric generator 38.

Accordingly, the burner 30 provides the functionality of a powered burner, in addition to providing lowered NOx emissions, without the use of external electrical power. The water heater 10 may therefore be used as a lowered NOx emission replacement for a natural draft water heater without the undesirable necessity of providing additional external electrical power to the replacement water heater. Additionally, even if either (or both) of the thermoelectric generator 38 and fan 44 fails to operate, the water heater 10 and burner 30 would continue to operate in a natural draft, non-powered mode (although with increased NOx emissions) until corrective service could be provided.

Figure 2:
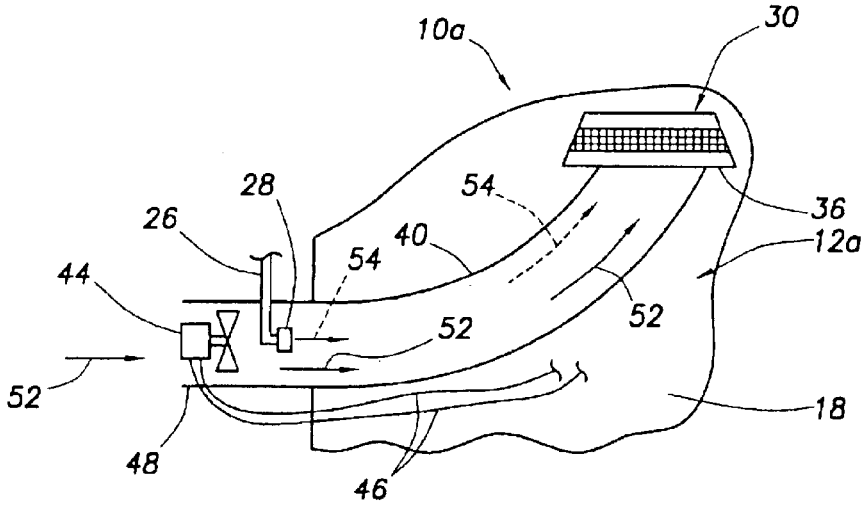
FIG. 2 is a schematic partial cross-sectional view through a first alternate embodiment of the FIG. 1 water heater.

FIG. 2 schematically depicts a portion of a first alternate embodiment 10*a* of the water heater 10 just described in conjunction with FIG. 1. The water heater 10*a* is identical to the water heater 10 with the exception that in the water heater 10*a* a modified burner/fuel-air delivery system 12*a* is utilized.

In the system 12*a* the previously described auxiliary combustion air supply duct 42 (see FIG. 1) is eliminated, and the combustion air supply fan 44 is installed in the inlet 48 of the fuel-air mixing duct 40 externally of the combustion chamber 18. During operation of the water heater 10*a*, and firing of the burner 30, the fan 44 is thermoelectrically driven by the generator 38 (not illustrated in FIG. 2) to force a second, additional quantity of combustion air 52 into and through the fuel-air mixing duct 40, to supplement the quantity of combustion air 52 which would normally be flowed inwardly through the duct 40 by the natural draft of the water heater 10*a*, for mixture with the fuel 54 and delivery to the burner 30.

Like the system 12, the modified system 12*a* increases the primary aeration of the burner 30 to correspondingly reduce the NOx emissions of the water heater 10*a*. Also, in the water heater 10*a* even if either (or both) of the thermoelectric generator 38 and combustion air supply fan 44 fails, the water heater 10*a* remains operative, albeit at a higher NOx emission rate, until corrective action can be taken.

Figure 3:
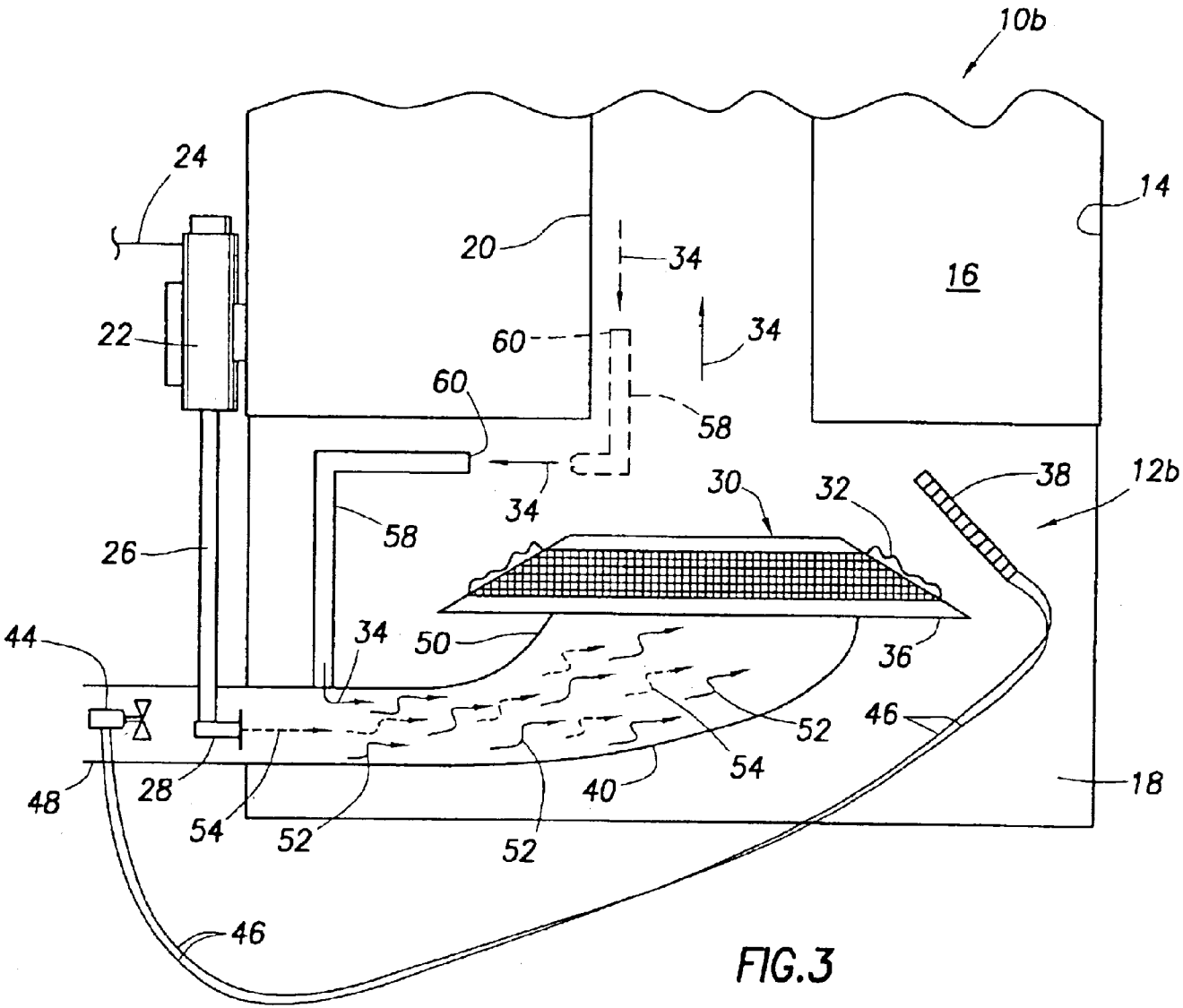
FIG. 3 is a schematic partial cross-sectional view through a second alternate embodiment of the FIG. 1 water heater.

FIG. 3 schematically depicts a second alternate embodiment 10*b* of the previously described water heater 10 shown in FIG. 1. water heater 10*b* is identical to the water heater 10*a* Just described in conjunction with FIG. 2 with the exception that the water heater 10*b* is provided with a modified burner/fuel-air delivery system 12*b*. System 12*b* is identical to the system 12*a* shown in FIG. 2 with the exception that the system 12*b* further includes an auxiliary flue gas recirculating duct 58. Duct 58 is positioned within the combustion chamber 18, is connected as shown to the fuel-air mixture duct 40, and has an open inlet end 60 which, as indicated in solid line form in FIG. 3, may be disposed within the combustion chamber 18 or, as indicated in phantom in FIG. 3, may alternatively be disposed within the interior of the flue 20.

During operation of the water heater 10*b*, generated combustion gases 34 are drawn into the duct 58 (by venturi action at its connection to the duct 40) and into the duct 40 for mixture with the air 52 and fuel 54 flowing therethrough to the burner 30. Accordingly, the system 12*b* lowers the NOx emissions of the water heater 10*b* in two manners namely, by (1) increasing the primary aeration of the burner 30, and (2) providing for flue gas recirculation to the burner 30. As in the case of the previously described water heaters 10 and 10*a*, the water heater 10*b* desirably remains operative (in a natural draft mode) despite failure of either or both of the thermoelectric generator 38 and auxiliary combustion air supply fan structure 44.

Figure 4:
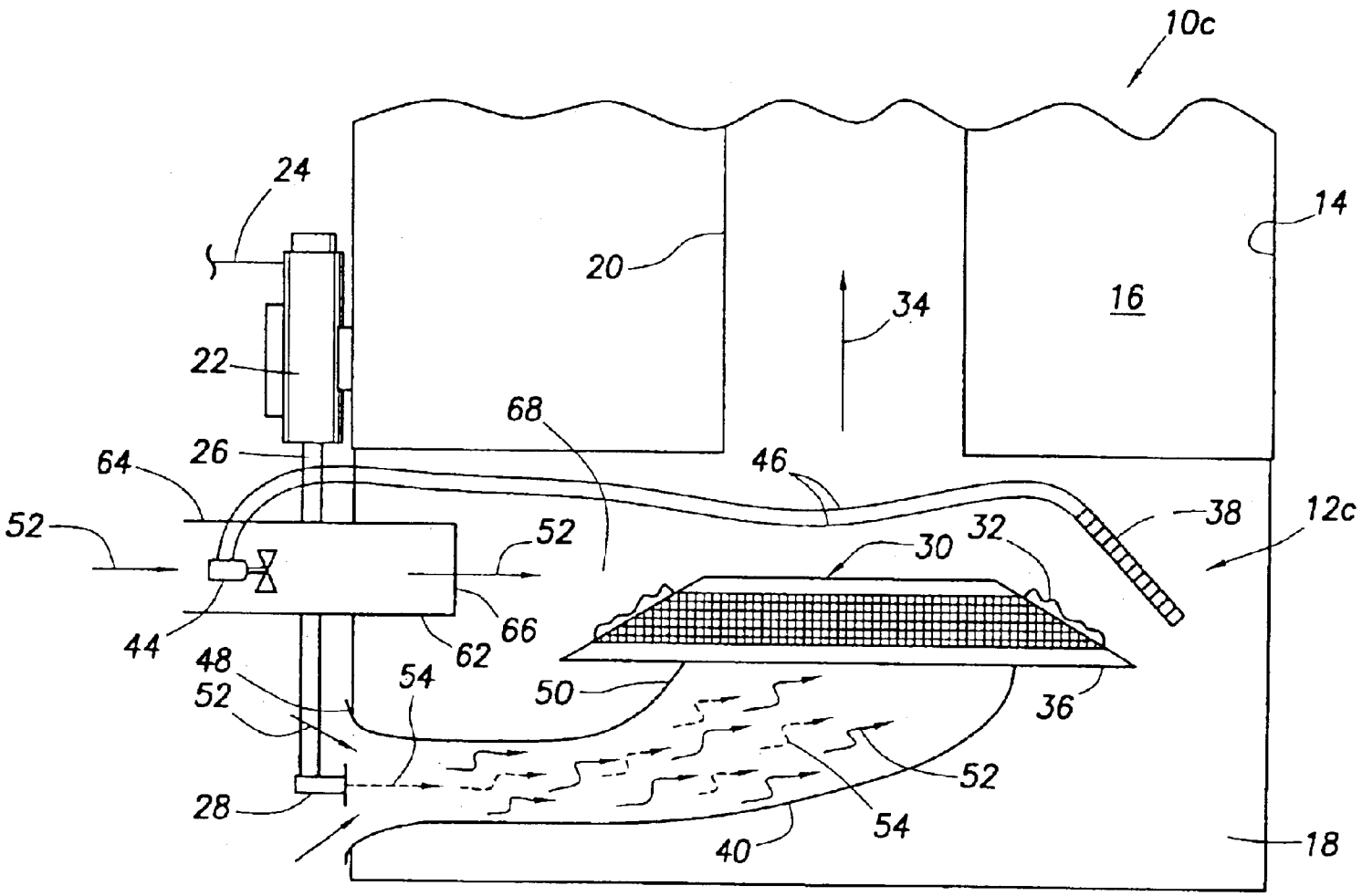
FIG. 4 is a schematic partial cross-sectional view through a third alternate embodiment of the FIG. 1 water heater.

A third alternate embodiment 10*c* of the previously described water heater 10 is schematically illustrated in FIG. 4 and is identical to the water heater 10 with the exception that the water heater 10*c* is provided with a modified burner/fuel-air delivery system 12*c*. System 12*c* is similar to the previously described burner/fuel-air delivery system 12 (see FIG. 1) with the exception that the auxiliary combustion air supply duct 42 shown in FIG. 1 as being connected to the fuel-air mixing duct 40 is eliminated and replaced with an auxiliary combustion air supply duct 62 (in which the fan 44 is disposed) which is not connected to the fuel-air mixing duct 40.

As illustrated in FIG. 4, the duct 62 extends into the combustion chamber 18 and has an open inlet end 64 (within which the fan 44 is disposed) external to the combustion chamber 18, and an open outlet end 66 disposed adjacent a secondary combustion zone 68 near the burner 30 within the combustion chamber 18. During operation of the water heater 10*c*, a first quantity of combustion air 52 is drawn into the inlet 48 of the fuel-air mixing duct 40 and mixed with fuel 54 flowing therethrough to the burner 30. At the same time, thermoelectrically driven operation of the fan 44 forces a second quantity of combustion air 52 into the secondary combustion zone 68, via the duct 62, to thereby lower the NOx emissions of the water heater 10*c* via a staged combustion mechanism.

As can be seen, even if either (or both) of the thermoelectric generator 38 and the auxiliary combustion air supply fan 44 fails the water heater 10*c* can continue to operate, in a natural draft mode in which air 52 and fuel 54 are drawn through the duct 40 to the burner 30, until corrective action can be taken.

The foregoing detailed description is to be clearly understood as being given by way of illustration and example only, the spirit and scope of the present invention being limited solely by the appended claims.

What is claimed is:

1. Fuel-fired heating apparatus comprising:

a combustion chamber;

a fuel burner disposed within said combustion chamber; and a fuel-air delivery system for delivering fuel and combustion air to said fuel burner for combustion thereby to form combustion gases, said fuel-air delivery system including a fuel supply structure operative to discharge a quantity of fuel received from a source thereof, a first flow path for receiving the discharged fuel and a first quantity of combustion air and flowing the received fuel and air to said burner, a thermoelectric generator positioned to be heated by said burner during firing thereof, a second flow path through which a second quantity of combustion air may be delivered to said burner, and a fan structure operable by said thermoelectric generator to deliver at least one of said first and second quantities of combustion air to said burner, all combustion air utilized by said apparatus interiorly traversing said fuel burner and being mixed with fuel before entering said fuel burner, said fuel-fired heating apparatus being operable even if either or both of said thermoelectric generator and said fan structure fail to function.

2. The fuel-fired heating apparatus of claim 1 wherein said apparatus is a fuel-fired water heater.

3. The fuel-fired heating apparatus of claim 2 wherein said fuel-fired water heater is a gas-fired water heater.

4. The fuel-fired heating apparatus of claim 2 wherein said fuel-fired water heater is a natural draft water heater.

5. The fuel-fired heating apparatus of claim 1 wherein said first and second flow paths are at least partially coextensive.

6. The fuel-fired heating apparatus of claim 1 wherein said first flow path is defined by a fuel-air mixing duct extending into and through said combustion chamber to an inlet portion of said burner, said fan structure is connected in said fuel-air mixing duct, and said second flow path extends through the interior of said fuel-air mixing duct.

7. The fuel-fired heating apparatus of claim 6 wherein said fan structure is disposed externally of said combustion chamber.

8. Fuel-fired heating apparatus comprising:

a combustion chamber;

a fuel burner disposed within said combustion chamber; and a fuel-air delivery system for delivering fuel and combustion air to said fuel burner for combustion thereby to form combustion gases, said fuel-air delivery system including a fuel supply structure operative to discharge a quantity of fuel received from a source thereof, a first flow path for receiving the discharged fuel and a first quantity of combustion air and flowing the received fuel and air to said burner, a thermoelectric generator positioned to be heated by said burner during firing thereof, a second flow path through which a second quantity of combustion air may be delivered to said burner, and a fan structure operable by said thermoelectric generator to deliver at least one of said first and second quantities of combustion air to said burner, said fuel-fired heating apparatus being operable even if either or both of said thermoelectric generator and said fan structure fail to function, and said first flow path being defined by a fuel-air mixing duct extending into and through said combustion chamber to an inlet portion of said burner, a portion of said second flow path being defined by an auxiliary combustion air duct extending into said combustion chamber and being connected to said fuel-air mixing duct, and said fan structure being coupled to said auxiliary combustion air duct and being operative to flow said second quantity of combustion air therethrough.

9. The fuel-fired heating apparatus of claim 8 wherein said fan structure is disposed externally of said combustion chamber.

10. The fuel-fired heating apparatus of claim 8 wherein said apparatus is a fuel-fired water heater.

11. The fuel-fired heating apparatus of claim 10 wherein said fuel-fired water heater is a gas-fired water heater.

12. The fuel-fired heating apparatus of claim 10 wherein said fuel-fired water heater is a natural draft water heater.

13. A fuel-fired water heater comprising:

a tank for storing water;

a combustion chamber;

a fuel burner disposed within said combustion chamber and operable to receive and combust a fuel-air mixture to thereby create hot combustion gases;

a flue communicated with said combustion chamber and operative to receive and discharge combustion gases formed by said burner, and to transfer combustion gas heat to water stored in said tank; and a fuel-air delivery system for delivering fuel and combustion air to said fuel burner, said fuel-air delivery system including a fuel supply structure operative to discharge a quantity of fuel received from a source thereof, a fuel-air mixing duct, extending into and through said combustion chamber to an inlet portion of said burner, for receiving the discharged fuel and a first quantity of combustion air and flowing the received fuel and air to said burner, a thermoelectric generator positioned to be heated by said burner during firing thereof, an auxiliary combustion air duct extending into said combustion chamber and being connected to said fuel-air mixing duct, and a fan structure operative to flow said second quantity of combustion air through said auxiliary combustion air duct and into said fuel-air mixing duct.

14. A fuel-fired water heater comprising:

a tank for storing water;

a combustion chamber;

a fuel burner disposed within said combustion chamber and operable to receive and combust a fuel-air mixture to thereby create hot combustion gases;

a flue communicated with said combustion chamber and operative to receive and discharge combustion gases formed by said burner, and to transfer combustion gas heat to water stored in said tank; and a fuel-air delivery system for delivering fuel and combustion air to said fuel burner, said fuel-air delivery system including a fuel supply structure operative to discharge a quantity of fuel received from a source thereof, a fuel-air mixing duct, extending into and through said combustion chamber to an inlet portion of said burner, for receiving the discharged fuel and a first quantity of combustion air and flowing the received fuel and air to an inlet portion of said burner, a thermoelectric generator positioned to be heated by said burner during firing thereof, and a fan structure coupled to said fuel-air mixing duct, disposed externally of said combustion chamber, and being operative by said thermoelectric generator to flow a second quantity of combustion air, in addition to said first quantity of combustion air, through said fuel-air mixing duct to said inlet portion of said burner, all combustion air utilized by said apparatus interiorly traversing said fuel burner and being mixed with fuel before entering said fuel burner.

* * * * *